US006393980B2

(12) United States Patent
Simons

(10) Patent No.: US 6,393,980 B2
(45) Date of Patent: May 28, 2002

(54) METHOD OF FORMING AN IMAGE BY INK JET PRINTING

(75) Inventor: Michael J. Simons, Middlesex (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/732,670

(22) Filed: Dec. 8, 2000

Related U.S. Application Data

(63) Continuation of application No. 09/174,185, filed on Oct. 16, 1998, now abandoned.

(30) Foreign Application Priority Data

Oct. 18, 1997 (GB) ..... 97022048

(51) Int. Cl.[7] ..... B41C 1/14

(52) U.S. Cl. ..... 101/128.21; 101/128.4; 347/103

(58) Field of Search ..... 101/128.21, 128.4; 347/96, 102, 103; 430/308; 427/143, 271, 273

(56) References Cited

U.S. PATENT DOCUMENTS

| | | | | |
|---|---|---|---|---|
| 4,254,194 A | * | 3/1981 | Merrill et al. | 101/128.21 |
| 4,388,137 A | | 6/1983 | McCarty et al. | 156/275.5 |
| 4,477,557 A | | 10/1984 | Rauch | 430/308 |
| 5,464,729 A | | 11/1995 | Hoebener et al. | 430/396 |
| 5,466,653 A | | 11/1995 | Ma et al. | 347/95 |
| 5,532,118 A | | 7/1996 | Bauer et al. | 430/533 |
| 5,589,434 A | | 12/1996 | Takahara et al. | 503/227 |
| 5,645,888 A | | 7/1997 | Titterington et al. | 427/256 |

FOREIGN PATENT DOCUMENTS

| | | |
|---|---|---|
| GB | 1431462 | 4/1976 |

* cited by examiner

*Primary Examiner*—Stephen R. Funk

(57) ABSTRACT

An image is formed by providing a coating of a crosslinkable polymeric substance on a first substrate, and applying a pattern or image of crosslinker to the coated substrate by ink jet printing to crosslink the polymeric substance. Uncrosslinked polymer is removed by washing the coated substrate, and the crosslinked polymer is then transferred imagewise to a second substrate.

9 Claims, No Drawings

METHOD OF FORMING AN IMAGE BY INK JET PRINTING

CROSS-REFERENCE TO RELATED APPLICATION

This is a Continuation of application Ser. No. 09/174,185 filed Oct. 16, 1998, now abandoned.

FIELD OF THE INVENTION

The invention relates to a method of forming an image by imagewise crosslinking a polymeric substance by ink jet printing a crosslinker onto it.

BACKGROUND OF THE INVENTION

It has been known to form images by selectively crosslinking materials by applying light to a crosslinkable resin. The technique has been used for forming photoresists where, after uncrosslinked material has been removed, etching of metal or glass is carried out. The technique has also been used to form silk-screen or screen-printing materials where the uncrosslinked material is washed out of the screen to create the finished printing screen. Such techniques are disclosed in "Light Sensitive Systems" by J. Kosar, published by John Wiley and Sons, Inc., New York, 1965, and in "Screen Process Printing" by J. Stephens, published by Blueprint (an imprint of Chapman and Hall), London, 1996.

These techniques, while successful, are expensive as they require expensive light imaging apparatus. Further they require expensive resins that will crosslink when exposed to light. There is difficulty in forming thick coats of crosslinked polymer as the light can not penetrate through thick crosslinkable resins, particularly when they are colored. Further, only very expensive imaging equipment could accurately produce fine quality images.

U.S. Ser. No. 09/089,903, filed Jun. 3, 1998, now abandoned, by Simons et al and entitled Method of Forming an Image describes a method of forming an image which comprises providing a coating of a crosslinkable polymeric substance on a substrate, applying a pattern of crosslinker to the coated substrate by ink jet printing to crosslink the polymeric substance in the pattern of the crosslinker, and washing the coated substrate to remove crosslinkable polymer in the area not having the pattern of crosslinker applied thereto. The substrate may be a screen printing screen.

There is a need for alternative methods of providing hardened polymeric images in layers of crosslinkable materials that are accurate and low in cost.

A particular problem with the method of the noted U.S. Ser. No. 09/089,903 is that transporting some substrates, for example, a screen mesh through an ink jet printer is difficult.

SUMMARY OF THE INVENTION

The invention provides a method of forming an image comprising:

- providing a coating of a crosslinkable polymeric substance on a first substrate,
- applying a pattern of a first crosslinker to the coated first substrate by ink jet printing to crosslink the polymeric substance,
- washing the coated first substrate to remove the crosslinkable polymer in the areas not having the first crosslinker applied thereto, and
- transferring the crosslinked polymer on the first substrate to a second substrate.

Another embodiment of this invention provides a method of forming an image comprising:

- providing a coating of a crosslinkable polymeric substance on a first substrate,
- applying a pattern of a first crosslinker to the first coated substrate by ink jet printing to crosslink the polymeric substance in the applied pattern of the crosslinker,
- washing the coated first substrate to remove the crosslinkable polymer in the areas not having the pattern of the first crosslinker applied thereto,
- patternwise transferring crosslinked polymeric substance to a foraminous substrate,
- bringing the foraminous substrate into contact with a receiving material,
- applying an ink to the foraminous substrate, and
- removing the foraminous substrate to leave a pattern on the receiving material.

This invention can provide accurate low cost silk screens and colored relief images on a variety of substrates using materials that are not light sensitive.

The invention has numerous advantages over previous processes of forming crosslinked images in crosslinkable materials. The invention is low in cost and can use a common ink jet printer to create accurate and low cost images. This printing technique allows images to be formed by printing from a computer onto a substrate that does not have to be kept in the dark. The substrate may be formed of a dry material that may be easily handled in the light and then washed with water to remove uncrosslinked polymer. The material does not need to be flat during imaging as in many light exposing techniques.

The method is much simpler to operate than existing decoration or fabrication techniques using light-induced hardening of polymeric layers by light exposure through an optical pattern. It does not involve light-sensitive materials, nor toxic materials like potassium dichromate. It provides a versatile decoration and fabrication technique to anyone with a computer and ink-jet printer fitted with a suitable cartridge, and has the potential to open a wide range of craft applications involving decoration and images to a large number of people. These and other objects will become apparent from the detailed description below.

DETAILED DESCRIPTION OF THE INVENTION

The invention comprises a process for printing, marking or fabricating images, patterns or marks from electronic information by writing by means of ink-jet printing means which deposits in a pattern a first crosslinker onto a first substrate which bears a layer of crosslinkable or hardenable polymeric material, and then treating the first substrate to cause a distribution of hardened or crosslinked polymeric material according to the deposited pattern. The crosslinked polymeric material pattern is then transferred to a second substrate, for example, a screen printing screen.

The pattern of crosslinked polymeric material may constitute the desired image, or may be subsequently treated, for example, by dyeing to give the desired image. The image may then be used as a mask for a subsequent process, such as printing or etching.

The first substrate may be regarded as a temporary support as the pattern of hardened or crosslinked polymer is transferred from the first substrate to the desired second substrate.

Transfer may be achieved by contacting the second substrate with the pattern of crosslinked polymer on the first substrate, arranging for the crosslinked polymer to adhere preferentially to the second substrate, and then separating the first and second substrates.

A number of ways of arranging for the crosslinked polymer to adhere preferentially to the second substrate are available. For example, it may be possible to choose appropriate materials such that the second substrate has a natural affinity for the crosslinked polymer that is greater than the crosslinked polymer affinity for the first substrate.

Alternatively, transfer may be achieved by contacting the second substrate with the pattern of crosslinked polymer in the presence of an agent which promotes adhesion of the crosslinked polymer to the second substrate. For example, the adhesion promoting agent may comprise a layer of polymeric material attached to the second substrate which has a higher affinity for the crosslinked polymer. Alternatively, the second substrate may bear a second crosslinker agent (either a second quantity of the first crosslinker or a different type of crosslinker) that causes the crosslinked polymeric material in contact with the second substrate to crosslink further and thereby become attached preferentially to the second substrate. The second quantity or type of crosslinker may be applied to the first substrate after washing instead of or in addition to its application to the second substrate. Additionally, the second substrate may be pre-treated with polymeric or other materials that increase the effect of the adhesion promoting agent.

The first substrate may be any suitable material for printing with an ink jet printer. Suitable materials include cloth, metal, paper and plastic sheets. If a plastic sheet is used for the substrate it may be any of the common polymer sheet materials such as polyethylene, polypropylene, cellulose acetate and polyester.

The second substrate may comprise a foraminous material such as a permeable woven or fibrous material, such as silk fabric, polyester or polyamide mesh, or open-weave paper. In a particularly preferred embodiment of the invention, the second substrate is screen printing screen i.e. a screen mesh material suitable for use in screen printing. In this case, a pattern-wise distribution of crosslinked polymer will block the interstices of the mesh, for example, the spaces between the fibers, to allow silk-screen printing through the material onto another substrate.

The use of a fabric or mesh of cloth or metal is preferred as this allows the formation in a low cost manner of a screen-printing screen of high quality.

Any suitable crosslinkable polymeric material may be used in the invention. Typical materials include polymeric materials having carboxylic acid, amino, hydroxyl, unsaturated or epoxy functional groups. Suitable crosslinkable polymeric materials are gelatin, polymers of acrylic, methacrylic or maleic acid or anhydride or their copolymers with ethylene, styrene or vinyl ethers, and polyamine polymers such as polyethyleneimine. Most preferred is gelatin as it is safe, easily coated, and readily washed off if not crosslinked. The gelatin may be present with other polymeric materials, particularly carboxylic acid-containing polymers and gelatin-compatible latexes.

For example, gelatin has been found to be a suitable crosslinkable polymeric material, and suitable crosslinkers for gelatin are described below. After application of the pattern of crosslinking fluid, the unhardened gelatin may be removed by washing with warm (>35° C.) water to leave a residual pattern of hardened gelatin, which may contain a dye or pigment, or may be subsequently dyed or pigmented.

Any suitable ink jet printer may be used in practice of the invention. The printer must be able to operate with a solution of the crosslinker substituted for the standard ink in the ink cartridge. As is known ink jet printers of the "drop on demand" type generally operate by ejecting ink droplets by means of a pressure pulse induced by a piezoelectric impulse or by a thermal pulse ("bubble jet"). Either type of printer is suitable for the invention, provided that the solution of the crosslinker is formulated to have chemical and physical properties, including viscosity and surface tension, appropriate to the printer.

Other types of ink jet printer may also be used, including "continuous working" types which eject a continuous stream of droplets which are deflected by an electrostatic field as required, while other types may use a long array of ink jet nozzles. The transport of the substrate to be printed can be varied to suit. For instance, film or paper substrates can be transported around rollers in the printer in the normal way.

The first crosslinker will depend on what crosslinkable polymeric substance is used in the process. Any material that may be placed in a liquid suitable for use in an ink jet may be used. Many materials are known to act as hardening or crosslinking agents for gelatin, see for example chapter 2 of "The Theory of the Photographic Process", Fourth Edition, edited by T. H. James and published by the Eastman Kodak Company, 1977. Crosslinkers for gelatin include metal salts, aldehydes, N-methylol compounds, diketone compounds, sulphonate esters and sulfonyl halides, S-triazines, and active olefins including bis-vinyl sulfonyl compounds.

Especially suitable materials as the first crosslinker for gelatin include aqueous solutions of aldehydes including formaldehyde, glyoxal and glutaraldehyde; and aqueous solutions of polyvalent metal salts such as $Al^{3+}$, $Cr^{3+}$, $Fe^{3+}$, $Ce^{4+}$. The preferred crosslinkers for the gelatins are glutaraldehyde and trivalent metal salts. Also preferred are the aqueous salts of Al(III) and Cr(III), including their chlorides, sulfates and nitrates. The preferred crosslinkers for the carboxylic acid polymers and copolymers are polyvalent metal salts. Most preferred are the aqueous salts of Al(III), Cr(III) and Zn(II), including their chlorides, sulfates and nitrates. The preferred crosslinkers for amine-bearing polymers are aldehydes and active vinyl compounds.

The material used in the ink jet cartridge may be any material that is compatible with the first crosslinker. The preferred carrier liquid for the first crosslinker is water, but other solvents or co-solvents may be present. For the preferred metal salts the solvent would be substantially water. Humectant agents that are commonly present in ink-jet inks may be present, and these include high boiling point liquids such as glycerol, ethylene glycol, diethylene glycol, triethylene glycol and 2-pyrrolidinone, as well as solids with a high affinity for water such as trimethylolpropane. Other substances present in the liquid in the ink jet cartridge may include anti-bacterial agents and thickening agents. The various substances present in the carrier liquid for the crosslinker must be compatible with the crosslinker and with the ink-jet mechanism.

Other fillers and additives such as known in the art may be used in the polymeric materials of the invention. Typical of such materials are bactericides, fillers, ultraviolet absorbers and brighteners.

The polymeric materials may be colored before or after ink jet printing. The colorants are those such as anionic dyes such as Tartrazine or Acid Blue 92, cationic dyes such as Rhodamine 6G or Crystal Violet, zwitterionic dyes such as Acid Fuchsin, or finely dispersed pigments such as titanium dioxide or copper phthalocyanine. If colorants are added in a wash after hardening they may be the same or different.

In a particularly preferred embodiment of the invention, a pattern of crosslinked polymer, for example, gelatin is formed on the first substrate, for example, a polyester sheet, and the uncrosslinked polymer is removed by washing with a solvent, for example, water. The second substrate, for example, a screen mesh, is contacted against the wetted crosslinked pattern, preferably in the presence of an adhesion promoting agent, and the assembly is allowed to dry. The pattern of crosslinked polymer attached to the second substrate is peeled away from the first substrate. The second substrate can then be contacted with a receiving material, ink is applied, and an inked image or pattern is applied to the receiving material.

The following examples illustrate the practice of this invention. They are not intended to be exhaustive of all possible variations of the invention. Parts and percentages are by weight unless otherwise indicated.

EXAMPLE 1

An aqueous solution of gelatin, 7.35% w/w, together with poly (styrene-alt-maleic acid), sodium salt, 0.59%, w/w, was coated on unsubbed polyester film base at a wet thickness of 0.1 mm, and allowed to dry. It was then supercoated at 0.1 mm wet thickness with an aqueous solution of gelatin, 9.6% w/w, tri-isopropyl naphthalene sulphonate, 0.15% w/w, and a latex dispersion of a copolymer of methyl acrylate, 2-acrylamido-2-methylpropanesulfonic acid, sodium salt, and 2-acetoxymethylmethacrylate (88:5:7 by weight), 6.9% w/w, and the coating dried.

A portion of the dried coating was written to with a Hewlett Packard DESKJET™ 850C printer in which the black ink had been replaced in its cartridge by the following solution:

| | |
|---|---|
| $AlCl_3.6H_2O$ | 5.0 g |
| $MgCl_2.6H_2O$ | 8.0 g |
| Olin 10G surfactant | 0.084 g |
| water | 85.0 g |

The writing was in the form of printed text, varying between 8 and 48 point size, and was written in a negative sense, so that solution was applied to the background but not to the letters of the text.

The solution was allowed to dry, then the printed coating washed for 3 minutes in running water at 40° C. It was observed that the gelatin/polymer layers washed away from the unprinted areas, and a relief image of hardened gelatin remained according to the pattern which had been printed.

A piece of polyester chiffon fabric, which had been moistened with water, was laid on top of the still wet gelatin/polymer layer, and the assembly allowed to dry. When dry, the polyester chiffon was peeled away from the film base, and it was observed that the imaged gelatin/polymer layer was adhering to the polyester chiffon fabric, and had stripped away from the film base. The result was a stencil, adhered to the fabric screen, of clear text letters set in a background of gelatin/polymer. The stencil screen was supported in a frame, and fabric screen printing ink (supplied by Daler-Rowney of Bracknell, England) was passed through it using a squeegee device to give a print of the stencil pattern on a piece of polyester-cotton fabric which lay beneath the screen.

EXAMPLE 2

This example illustrates the use of an adhesion-promoting polymer in the coated stencil sheet as the screen attachment agent.

An aqueous solution of gelatin, together with poly (styrene-alt-maleic acid), sodium salt, was machine coated on unsubbed polyester film base to give a coated laydown of 2.0 g/m$^2$ of gelatin and 0.09 g/m$^2$ of poly(styrene-alt-maleic acid), sodium salt. The coating was dried then one portion was machine supercoated with gelatin to give a coated laydown of 4.0 g/m$^2$ (Coating A). Another portion was supercoated with a mixture of gelatin and the adhesion-promoting polymer in the form of a latex dispersion of a copolymer of methyl acrylate, 2-acrylamido-2-methylpropanesulfonic acid, sodium salt, and 2-acetoacetoxymethylmethacrylate (88:5:7 by weight), to give coated laydowns of 4.0 g/m$^2$ of gelatin and 1.0 g/m$^2$ of adhesion-promoting polymer (Coating B).

A portion of each coating was written to with a Hewlett Packard DESKJET™ 850° C. printer in which the black ink had been replaced in its cartridge by the following solution:

| | |
|---|---|
| $AlCl_3.6H_2O$ | 5.0 g |
| $MgCl_2.6H_2O$ | 8.0 g |
| Olin 10G surfactant | 0.084 g |
| water | 85.0 g |

The writing was in the form of printed text, varying between 8 and 48 point size, and was written in a negative sense, so that ink was applied to the background but not to the letters of the text.

The ink was allowed to dry, then the printed coating washed for 3 minutes in running water at 40° C. It was observed that the gelatin/polymer layers washed away from the unprinted areas, and a relief image of hardened gelatin/polymer remained according to the pattern which had been printed.

The imaged coatings, while still wet, were laid face down on a polyester screen printing screen, which comprised a polyester monofilament square mesh having 100 threads per centimeter, stretched on a printing frame. The assembly was allowed to dry thoroughly, then the polyester film base was peeled away from the screen mesh. In the case of Coating A, adherence of the gelatin/polymer to the screen was incomplete. In the case of Coating B, which had the adhesion-promoting polymer, the gelatin/polymer layer was attached firmly to the screen, the film base having peeled away cleanly. The stencil attached to the screen had a sharp image of the applied lettering, clear letters against a continuous background of polymer, suitable for screen printing.

EXAMPLE 3

This example illustrates the use of screen attachment agents additional to the adhesion-promoting polymer, one being gelatin applied to the screen, the other being a gelatin hardener imbibed into the stencil.

A stencil coating was prepared as follows:

An aqueous solution of gelatin, together with poly (styrene-alt-maleic acid), sodium salt, was machine coated on unsubbed polyester film base to give a coated laydown of 2.0 g/m$^2$ of gelatin and 0.06 g/m$^2$ of poly(styrene-alt-melic acid), sodium salt. The coating was dried and then was machine supercoated with a mixture of gelatin and the adhesion-promoting polymer in the form of a latex dispersion of a copolymer of methyl acrylate, 2-acrylamido-2-methylpropanesulfonic acid, and the sodium salt of 2-acetoxymethylmethacrylate (88:5:7 by weight), to give coated laydowns of 4.0 g/m$^2$ of gelatin and 1.4 g/m$^2$ of adhesion-promoting polymer.

The coating was written to using hardener ink in an ink jet printer as in Example 2.

The ink was allowed to dry, then the printed coating washed for 3 minutes in running water at 40° C. It was observed that the gelatin/polymer layers washed away from the unprinted areas, and a relief image of hardened gelatin/polymer remained according to the pattern which had been printed.

A screen printing mesh as in Example 2 was taken, and a strip of the screen running in a vertical direction was treated with a 0.3% w/w solution of gelatin in water, surplus solution blown away, and the screen dried. A strip of the imaged and washed stencil sheet, running in a horizontal direction, was dipped while still wet into a 0.9% w/w aqueous solution of the gelatin hardener bis(vinylsulfonyl) methane for one minute. Surplus liquid was allowed to run off, then the stencil sheet was laid coated face down on the prepared printing screen and the assembly allowed to dry. In this way, four different screen attachment conditions were obtained in different areas of the stencil: all areas had the adhesion-promoting polymer in the stencil sheet, plus the following additional screen attachment agents:

A. none

B. gelatin on screen mesh

C. extra hardener solution in stencil

D. extra hardener solution in stencil plus gelatin on screen mesh.

The assembly was allowed to dry overnight, then the polyester film base was peeled away to leave a clear stencil of the written text in all areas. It was observed that the stencil was less thoroughly attached to the screen in area A.

Sheets of paper were printed through the screen in the usual way, using a rubber squeegee and an aqueous acrylic ink consisting of Daler-Rowney System 3 Acrylic, diluted 3 parts to 2 parts of water.

After a few impressions, the stencil in area A had become damaged. After 30 impressions, area B was still printing but was showing signs of becoming damaged. After 80 impressions, areas C and D were both still giving clear sharp prints of the text written to the stencil by the ink jet printer.

The invention has been described in detail with particular reference to certain preferred embodiments thereof, but it will be understood that variations and modifications can be effected within the spirit and scope of the invention.

I claim:

1. A method of forming an image comprising:

providing a coating of a crosslinkable polymeric substance on a first substrate, applying a pattern of a first crosslinker to said coated first substrate by ink jet printing to crosslink said polymeric substance, washing said coated first substrate to remove said crosslinkable polymer in the areas not having said first cross-linker applied thereto, and transferring said crosslinked polymer on said first substrate directly to a second substrate wherein said second substrate is a mesh material suitable for screen printing.

2. The method of claim 1 wherein said crosslinkable polymeric substance is a polymer having carboxylic acid, amino, hydroxyl, unsaturated or epoxy functional groups.

3. The method of claim 1 wherein said crosslinkable polymeric substance is gelatin or a mixture of gelatin and one or more crosslinkable polymers.

4. The method of claim 1 wherein said first crosslinker is a metal salt, aldehyde, N-methylol compound, diketone compound, sulphonate ester and sulfonyl halide, S-triazine or active olefin.

5. The method of claim 1 wherein said first crosslinker is a salt of Al(III), Cr(III) or Zn(II).

6. The method of claim 1 wherein said crosslinked polymer is transferred to said second substrate with the aid of an agent which promotes adhesion of said crosslinked polymer to said second substrate.

7. The method of claim 6 wherein said adhesion promoting agent is a layer of polymeric material attached to said second substrate that has a high affinity for said crosslinked polymer.

8. The method of claim 6 wherein said adhesion promoting agent is a second crosslinker that is applied either to said first substrate after said washing step, or to said second substrate.

9. The method of forming an image comprising:

providing a coating of a crosslinkable polymeric substance on a first substrate, applying a pattern of a first crosslinker to said first coated substrate by ink jet printing to crosslink said polymeric substance in the applied pattern of the crosslinker, washing said coated first substrate to remove said crosslinkable polymer in the areas not having the pattern of said first crosslinker applied thereto, patternwise transferring crosslinked polymeric substance to a foraminous substrate, bringing said foraminous substrate into contact with a receiving material, applying an ink to said foraminous substrate, and removing said foraminous substrate to leave a pattern on said receiving material.

* * * * *